United States Patent [19]

Nagai

[11] 4,126,310

[45] Nov. 21, 1978

[54] LIGHT EMISSION WEAPON WITH SHUTTER MEMBERS

[75] Inventor: Nobuo Nagai, Nara, Japan

[73] Assignee: Nintendo Co., Ltd., Kyoto, Japan

[21] Appl. No.: 832,028

[22] Filed: Sep. 9, 1977

[30] Foreign Application Priority Data

Jun. 7, 1977 [JP] Japan ..... 52/067619

[51] Int. Cl.[2] ..... A63F 9/02; F41F 27/00

[52] U.S. Cl. ..... 273/101.1; 354/250

[58] Field of Search ..... 273/101.1; 362/113, 362/114, 112, 321; 354/250, 251, 253, 254

[56] References Cited

U.S. PATENT DOCUMENTS

| | | | |
|---|---|---|---|
| 604,733 | 5/1898 | Daniels | 354/250 |
| 1,867,109 | 7/1932 | Seifert | 354/253 |
| 2,070,529 | 2/1937 | Falkenberg | 273/101.1 |
| 2,236,390 | 3/1941 | Wood et al. | 273/101.1 |
| 2,995,834 | 8/1961 | Rowe | 273/101.1 |
| 4,050,166 | 9/1977 | Swiatosz et al. | 273/101.1 |

FOREIGN PATENT DOCUMENTS

| | | | |
|---|---|---|---|
| 432,453 | 8/1926 | Fed. Rep. of Germany | 273/101.1 |
| 2,619,384 | 4/1976 | Fed. Rep. of Germany | 354/250 |
| 37,272 | 11/1972 | Japan | 273/101.1 |
| 31,959 | 8/1974 | Japan | 273/101.1 |
| 50,400 | 12/1976 | Japan | 273/101.1 |
| 324,072 | 1/1930 | United Kingdom | 354/253 |

*Primary Examiner*—William H. Grieb
*Assistant Examiner*—Lawrence E. Anderson
*Attorney, Agent, or Firm*—Wenderoth, Lind & Ponack

[57] ABSTRACT

A light emission weapon including a filament electric bulb and a shutter which is momentarily actuated in association with a trigger to project a pulse light from its muzzle. This shutter includes a shutter element which comprises a first shutter member and a second shutter member which are independently shiftable to masking positions and non-masking positions with respect to the path of light from the bulb and are positioned parallel to each other. The shutter members have leg portions extending therefrom which are contacted by a drive pin on a drive disc to intermittently bring the shutter members into and out to the light beam.

4 Claims, 10 Drawing Figures

LIGHT EMISSION WEAPON WITH SHUTTER MEMBERS

BACKGROUND OF THE INVENTION

This invention relates to a light emission weapon for use in shooting games where the bombardment of a target by a light beam projected from a light emission weapon held by a player results in the incidence of light upon a photoelectric element to generate a hit signal and, thereby, to display the result of the shot.

A light emission weapon of the known type is such that a filament electric bulb goes on upon action of a trigger switch which is actuated in association with a trigger action. However, this weapon system is disadvantageous in that, due to the inherent characteristics of a filament bulb, the light obtained has no steep angle of rise and assumes a hill-shaped slope which results in a failure to discriminate the emitted light from the surrounding noise light (e.g. flickers of a fluorescent light). This failure often leads to a falsely successful display even when the photoelectric element is not properly bombarded. The use of a discharge (xenon) lamp in lieu of a filament bulb produces a pulse light having a rectangular waveform, thus enabling one to preclude erratic activation of the photoelectric element, but the costs of both the xenon lamp and the power circuit for energizing the lamp are so high that the practical utility of the device as a stimulated weapon is considerably reduced.

To overcome the above disadvantages, we invented and disclosed in Japanese Utility Model Publication Nos. 37272/1972 and 50400/1976 light emisson guns suited for shooting games. These light emission guns have a tungsten lamp and are adapted to mechanically generate a pulse light with a rectangular waveform and which feature a very short time during which the luminosity of the light to be projected is increased to the necessary level.

With such light emission guns, the momentary opening of the shutter mechanism disposed in front of a miniature electric bulb results in the production of a momentary glare of light approximating the pulse light of a discharge lamp, thus causing a sudden change in output signal from the photoelectric element to drive the display transistor circuit. However, this momentary emission of light does not produce a trailing residue of light visible to the human eye and, therefore, the player cannot confirm the correctness of his aiming angle (the proximity to the target of his shot). Thus, these guns offer only a low degree of enjoyment and have a low training value.

SUMMARY OF THE INVENTION

It is an object of the invention to provide a light emission weapon which produces an effective light and a trailing residiue of light which permits the player to correct his aim for the next shot, in addition to a limited time in which to perform a successful shot.

It is another object of the invention to provide a light emission weapon which will generate a series of effective pulse lights with corresponding trailing residua of light to create increased life — like shooting enjoyment.

It is still another object to provide a light emission weapon adapted to generate a firing sound synchronously with the generation of the pulse light to simulate the firing of a machine gun.

The light emission weapon system provided by this invention includes a shutter element disposed between a filament electric bulb and a muzzle and comprises a first shutter member, and a second shutter member, which are independently shiftable to and from the optical path of the system, and a shutter member lock means adapted to shift the first and second shutter members at scheduled timings so as to allow a pulse light to be projected toward a target with a trailing residue of light and thereby allow the player to visually confirm the position of his shot with respect to the target on a screen. This requires the player to accomplish a more critical agreement of timing between the moving target and his shot, thereby making the game more sophisticated and more realistic. The weapon according to this invention is further capable of producing a pulse light having an effective portion of sufficient intensity to preclude an erratic display of the shot, the production of the pulse light being mechanically accomplished without requiring any complicated and costly electrical component, thus contributing to a reduced manufacturing cost of the weapon.

In accordance with this invention, the first and second shutter members are continuously shifted at dissimilar timings by a drive means actuated in associated with a trigger to generate a pulse light consisting of the effective portion and the trailing residium of light immediately following said effective portion in a sequence to simulate the firing of a machine gun, thereby providing an increased degree of enjoyment.

Another embodiment of this invention further comprises a firing sound emitter adapted to generate a sound or a series of sounds in synchronously with the generation of the pulse light in response to the motion of the first shutter member for enhanced enjoyment.

BRIEF DESCRIPTION OF THE DRAWINGS

In the accompanying drawings

DETAILED DESCRIPTION OF PREFERRED EMBODIMENTS

Figure 1:
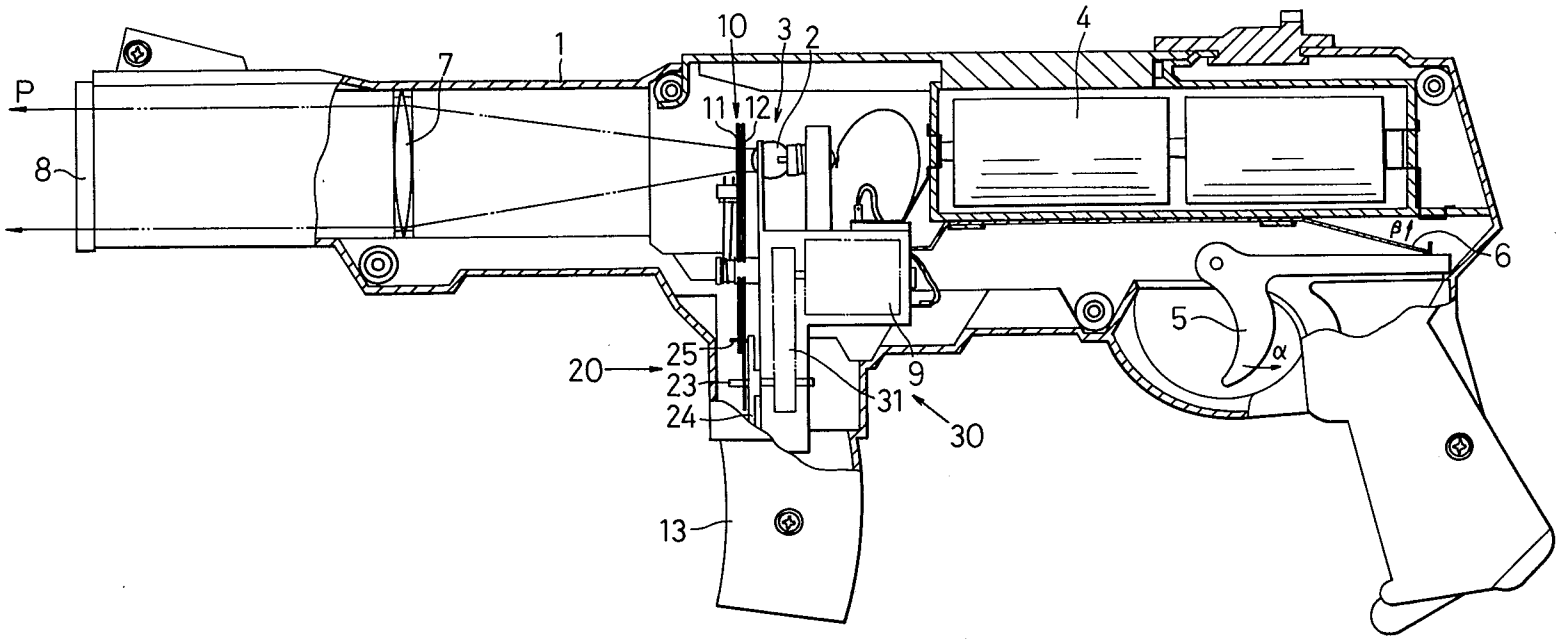
FIG. 1 is a longitudinal cross-section plan view showing a light emission weapon system embodying the principle of this invention.

Referring to FIG. 1, the light emission weapon system according to this invention comprises a barrel 1, a miniature electric bulb 2 of the tungsten filament type built into a central portion of the barrel 1, a shutter means 3 in front of the electric bulb, a battery (dry cells) 4 housed in a rear portion of said barrel, a trigger 5 and a switch 6 which is operatively associated with the trigger, the miniature electric bulb 2 being electrically connected to the battery 4 through the switch 5 in such a manner that tripping trigger 5 causes the electric bulb 2 to go on. Built into a front portion of said barrel 1 is an optical lens 7 which collimates the light rays from the electric bulb 2 and projects the collimated light (P) through a muzzle portion 8 of the barrel 1 onto a screen positioned externally of the weapon system.

The aforementioned dry cells 4, switch 6 operatively associated with the trigger 5 and an electric motor 9 with reduction gearing built into the central portion of the barrel 1 constitute a drive unit 30 for the weapon system.

Figure 2:
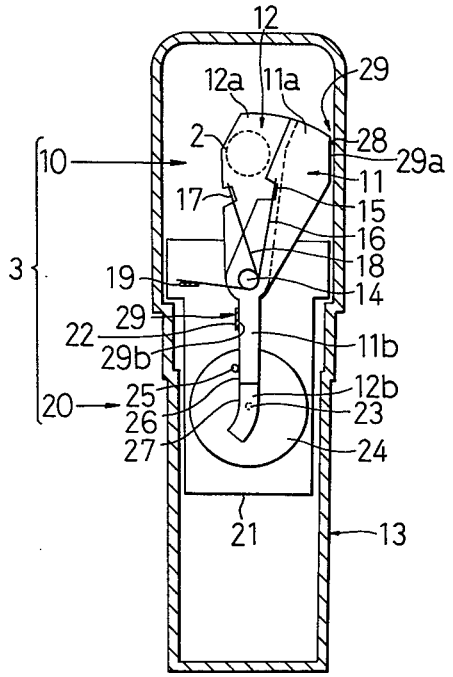
FIG. 2 is a cross-section view taken on the line S—S of FIG. 1.

Referring, now, to FIG. 2, the shutter means 3 comprises a shutter element 10 and shutter member lock means 20. The shutter element 10 comprises a first shutter member 11 and a second shutter member 12, both of which are operable to cover the front of the miniature electric bulb 2. Thus, via a pivot shaft 14, each of the two shutter members is pivotally mounted, at its base, onto a support plate 21 housed and secured alongside a drive case 31 in an appended case 13 extending downwardly from the central portion of the barrel 1. The two shutter members are independently shiftable in a direction normal to the axis of light (P). A first spring 16 is secured at one end thereof to a first projection 15 of the first shutter member 11, and a second spring 18 is secured at one end thereof to a second projection 17 of the second shutter member 12. The other ends of the springs 16, 18 are respectively engaged by a lock member 19 secured to the support plate 21. The strokes of a first leg 11*a* and a second leg 12*b* which are downward extensions of the first shutter member 11 and second shutter member 12, respectively, are limited by a stopper 22. And as to the shutter-operative portions 11*a*, 12*a* of the first shutter member 11 and second shutter member 12, respectively, the shutter-operative portion 12*a* of the second shutter member 12 and the shutter-operative portion 11*a* of first shutter member 11 are each biased into a position in the light path (masking position) and into a position where the passage of light is not interferred with (i.e. a non-masking position) by the first spring 16 and second spring 18, respectively, as will be apparent from FIG. 2.

The shutter member lock means 20 comprises a drive disc 24 rigidly secured to an outer end of a drive shaft 23 rotatably supported by a support plate 21 and a drive case 31. The drive disc 24 has a drive pin 25 rising therefrom in an offset position with respect to its center in such a manner that in the position where it does not act upon an abutting portion 26 formed by a lateral edge of the first leg 11*b* of the shutter member 11, nor does it act upon a second abutting portion 27 formed by a lateral edge of the second leg 12*b* of the second shutter member 12, it sets the second shutter member 12 in a masking position and the first shutter member 11 in a non-masking position, thereby setting the shutter element 10 as a whole in a masking phase as shown in IV and V of FIG. 5. Since the drive pin 25 abuts and shifts the first leg 11*b* and second leg 12*b* into the positions indicated in VI and I of FIG. 5, the first shutter member 11 is brought into its masking position and the second shutter member 12 is set in a non-masking position with the shutter element 10 as a whole being set in a masking phase, whereby a firing standby situation is established. Then, a momentary disengagement of the drive pin 25 from the first leg 11*b* causes the first shutter member 11 alone to shift momentarily into the non-masking position illustrated in II of FIG. 5. Then, as the drive pin 25 is further driven to disengage the second leg 12*b*, the second shutter member 12 shifts into its masking position. In this manner, the condition of FIG. 2 and FIG. 5-IV is restablished.

The drive shaft 23 of the drive disc 24 is coupled to a shaft 33 of an electric motor 9 through a reduction unit 32 so that the drive disc 24 may continue to turn during the revolution of the motor (*a*).

There may also be provided, according to this invention, a firing sound emitter 9 such that the upper outer peripheral edge 29*a* of said first shutter member 11 made of an iron sheet [the lateral edge opposite to a locking member for the spring] is disposed in a mutually facing and parallel relation with respect to the inner face 28 of a lateral wall of a pending case 13 made of rigid plastic material so that as the engagement between the first leg 11*b* of the first shutter member 11 and the drive pin 25 is released, the accumulated energy of the first spring 16 causes the upper portion 29*a* of the first shutter member to strike the inner face 28 of the lateral wall. As the upper portion 29*a* strikes the inner face 28, a reverberating series of discrete sounds is generated by virtue of the appended case 13 to simulate the firing sound of a machine gun.

This mechanism is further so designed that the energy accumulated in the second spring 18 is less than that in the first spring so that said sound is generated by the abutment of said upper portion 29*a* against the inner face 28 only when the first shutter member 11 is shifted, the number of sound emissions agreeing with the number of light pulses and both of them occurring in substantial synchronism.

The operation of the light emission weapon according to this invention will be described.

Figure 3:
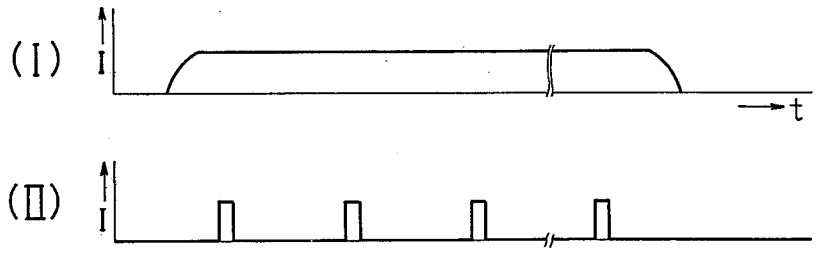
FIG. 3 is a schematic diagram showing the generation of a pulse light by the shift of a shutter element, where (I) corresponds to the light obtained without the shutter element and (II) corresponds to the light generated by the element, i.e. the pulse light projected from the muzzle.

In shooting with the light emisson weapon, the player aims the weapon generally at the screen and manipulates the trigger 5 to pivot it rearward [as indicated by arrow-mark ($\alpha$)]. Thereupon, the switch (6) turns in a direction indicated by the arrow-mark ($\beta$) to close its contact points, thus closing a circuit including the electric bulb 2 and a motor circuit including the electric motor 9, both being connected to the battery 4, whereupon the electrib bulb 2 goes on and the shutter means 3 starts a continuous motion. Referring to FIG. 3, whereas the electric bulb 2 keeps emitting light with a substantially constant luminosity during the operation of the trigger 5 from the start of operation to the end of operation as indicated in the upper stage (I), the continuous operation of the shutter means 3 causes a pulse light like the one shown in the lower stage (II) to be continuously generated and projected from the muzzle 8.

Figure 4:
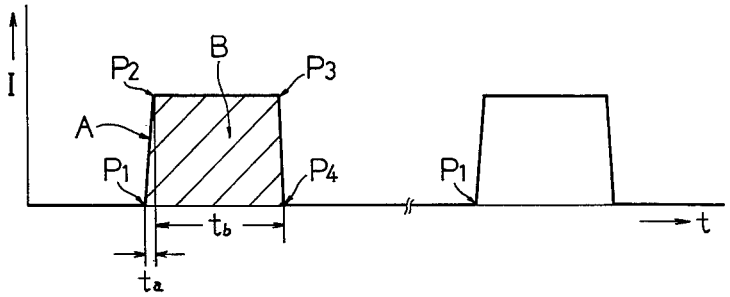
FIG. 4 is an enlarged view showing the pulse light (II) in which the change from $P_1$ to $P_2$ corresponds to the change before and after the non-masking shift of the first shutter member, ta represents an effective portion (A), and tb represents a trailing residiue of light (B)

In the operation of the shutter means 3, due to a delay between the operation of the first shutter member 11 and the operation of the second shutter member 12, the pulse light projected from the muzzle 8 comprises an effective portion (A) ($P_1 \rightarrow P_2$ in FIG. 4) corresponding to the operation timing of the first shutter member 11 and a trailing residiue of light (B) (corresponding to a residual image of the bullet) which corresponds to the time tb (50 milliseconds in the embodiment) between the end of the operation of the first shutter member 11 and the start of the operation of the second shutter member 12 ($P_2 \rightarrow P_3 \rightarrow P_4$ in FIG. 4).

Figure 5:
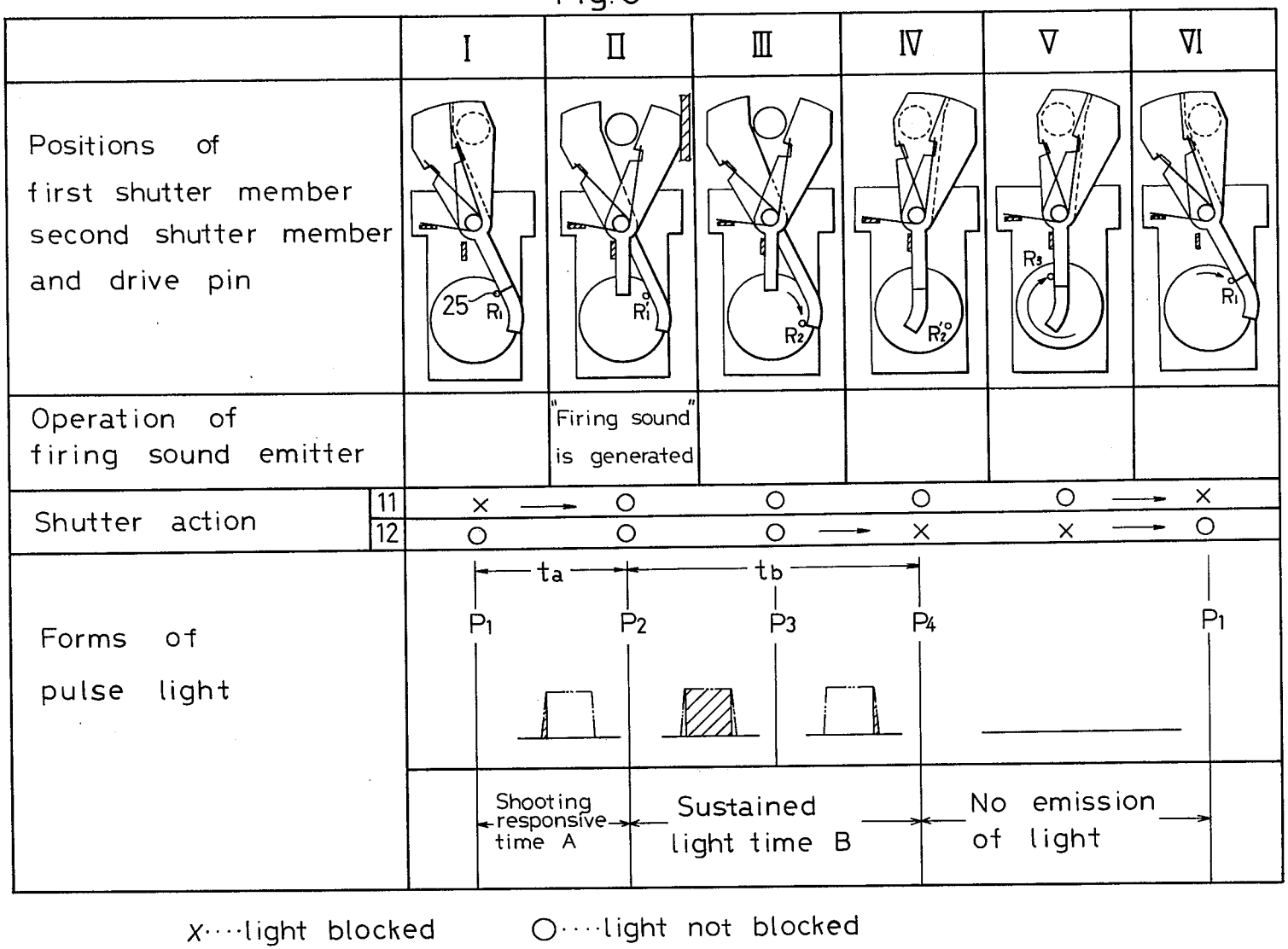
FIG. 5 is a schematic diagram showing the generation of pulse light and the firing sound by the operation of the shutter means.

The above operation will be described in further detail with reference to FIGS. 4 and 5. As the drive pin 25 shifts to point $R_1'$ which is a little distance away from point $R_1$, the shutter element 10 is varied in phase from FIG. 5 I → FIG. 5 II, thus allowing an effective part (A) of the pulse light to be projected. Then, as the drive pin 25 passes $R_2$ to point $R_2'$ which is a little distance away from $R_2$, the shutter element 10 enters into another phase, i.e. from FIG. 5 II to FIG. 5 III to FIG. 5 IV, thus causing a trailing portion (B) of light to be projected. Until the drive pin 25 returns from $R_2'$ to $R_1$ through $R_3$, the shutter element 10 is in a masking phase, thus preventing the pulse light from being generated. However, although the shutter element 10 as a whole remains in the masking phase during the period of return motion of the drive pin 25 from $R_3$ to $R_1$, the first shutter member 11 on the one hand shifts from its non-masking position to its masking position and the second shutter member on the other hand shifts from its masking position to its non-masking position, whereby the shutter element 10 as a whole is brought into the standby phase for a next emission of pulse light.

Figure 6A:
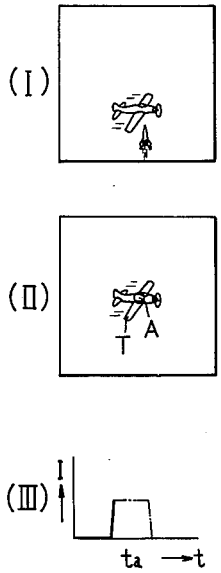
FIG. 6A and 6B are schematic views showing a successful shot in a simulated situation versus an actual situation, FIG. 6A corresponds to the effective portion (A), FIG. 6B corresponds to the trailing residue of light (B).
Figure 6B:
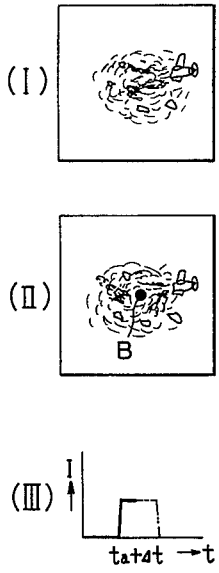

The shooting time schedule is illustrated in FIG. 6.

In an actual shooting situation, the target moves in a direction which is a composite of the X- and Y-axes or three-dimensionally and the bullet also has a flight path so that the hitting position shifts constantly. In a simulated shooting situation, too, a successful shot should occur and be indicated only when the effective light (A) coincides with the target. Thus, only when the effective portion of pulse light (A) has hit the target (T), a condition comparable to a successful shot [FIG. 6 A(I)] in an actual shooting situation is developed and at the time when the trailing residue of light (B) hits the target, the condition of FIG. 6B (II) prevails.

Figure 7A:
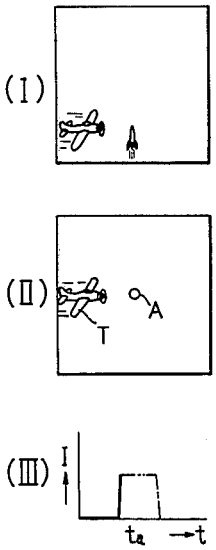
FIG. 7A and 7B are schematic views similar to FIG. 6A, 6B showing an unsuccessful shot.
Figure 7B:
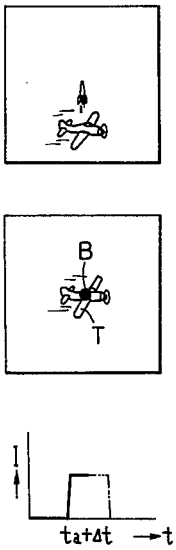
Figure 7C:
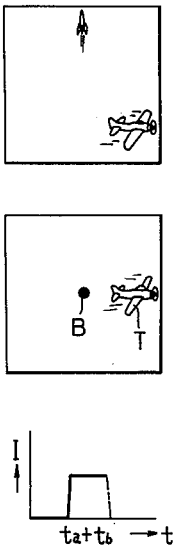
FIG. 7C is a schamatic view and corresponds to the end portion of the trailing residue (B).

Unless there is an agreement between the target and the effective portion (A) of pulse light, the target keeps flying away but where the effective light (A) hits a space closely ahead of the target (T), the residiue of light (B) hits the target (T) as indicated in FIG. 7 B (II). However, since the flying target is moving at a speed of 20 mm/0.1 second, for instance, and the light beam projected 10 mm ahead of the target in the path of flight has about 50 milliseconds of "trailing light", it appears to the eye that the flying object enters into the spot of light on the screen; i.e. apparently a successful shot has taken place. Since this corresponds to the condition of FIG. 7 B (I) in an actual shooting situation, it is an unsuccessful shot. In this case, since the effective light (A) is not aligned with the target, no success signal is produced, with the flying object continuing its flight.

The overall simulation effect is as if a bullet with a tail of light flew away into the space to indicate the direction of flight of the bullet.

During the operation of the trigger 5, the drive disc 24 is driven by the motor 9 via a reduction unit 32 and the pulse light of FIG. 4 is omitted continuously as indicated in FIG. 3 (II).

The sound emitting part 29*a* of the first shutter member 11 produces a sound as it strikes the inner face 28 of the lateral wall of the pending case 13 and since this emission of sound takes place in synchrously with the generation of pulse light by the first shutter member 11, the firing sound emitter 29 generates a series of sounds simulating that of a machine gun. The appended case 13 is a hollow structure provided within the barrel 1 so that it acts as a resonator to amplify the sound generated by the abutment of the sound emitting part 29*a*.

What is claimed is:

1. A shutter device in combination with a light emission weapon which emits a light beam through a muzzle from a filament electric bulb connected to a power source, said shutter device comprising:

first and second shutter members pivotably mounted in said weapon so as to selectively intercept and block said light beam, said shutter members being parallel to and independent of each other;

said first shutter member having a first leg extending therefrom;

said second shutter member having a second leg extending therefrom in the same direction as said first leg, said second leg being longer than said first leg such that said first said leg coextends for only a portion of the length of said second leg;

a rotatable drive disc adjacent said first and second legs;

means connected to said drive disc for rotating said drive disc;

first biasing means contacting said first shutter member for continuously urging said first shutter member away from said light beam;

second biasing means contacting said second shutter member for continuously urging said second shutter member into said light beam; and at least one pin member means extending from the face of said drive disc in the direction of said leg members for intermittently contacting the coextending portions of both leg members simultaneously during rotation of said disc and urging said first shutter member against said first biasing means into said light beam and urging said second shutter member against said second biasing means away from said light beam, for intermittently contacting the non-coextending portion of said second leg member alone during rotation of said disc and urging said second shutter member away from said light beam, whereby neither shutter member intercepts said light beam, and for intermittently contacting neither leg member during rotation of said disc, whereby said first shutter member is urged away from said light beam by said first biasing means and said second shutter member is urged into said light beam by said second biasing means.

2. A device as claimed in claim 1 wherein said means for rotating said drive disc is comprised of:

a motor;

a switch for starting said motor; and a reduction gear connecting said motor to said drive disc.

3. A device as claimed in claim 2 wherein said weapon has a trigger, and said trigger is connected to both said switch and said filament bulb, and when pulled said trigger simultaneously causes said switch to start said motor and said filament bulb to light.

4. A device as claimed in claim 2 wherein said motor is electric and is connected to the same power source as said filament bulb.

* * * * *